US006079189A

United States Patent [19]

Sloot

[11] Patent Number: 6,079,189

[45] Date of Patent: Jun. 27, 2000

[54] ARTICLE HOLDERS FOR USE IN CREATING DISPLAY ARTICLES

[75] Inventor: Alexander Sloot, Sugarloaf, Pa.

[73] Assignee: Printmark Industries, Inc., Hazelton, Pa.

[21] Appl. No.: 08/899,239

[22] Filed: Jul. 23, 1997

Related U.S. Application Data

[60] Provisional application No. 60/022,358, Jul. 24, 1996.

[51] Int. Cl.[7] ..... B65B 47/00

[52] U.S. Cl. ..... 53/453; 53/468; 53/471; 493/90; 493/912

[58] Field of Search ..... 53/453, 559, 381.1, 53/468, 471, 485; 493/90, 912

[56] References Cited

U.S. PATENT DOCUMENTS 3,472,723 10/1969 Lemelson ..... 53/559 X 3,780,856 12/1973 Braverman ..... 53/471 X 5,788,079 8/1998 Bouthiette ..... 53/471 X

*Primary Examiner*—Linda Johnson

*Attorney, Agent, or Firm*—St. Onge Steward Johston & Reens LLC

[57] ABSTRACT

A method and apparatus are described for making various packages that are easily assembled into arrays for use in small runs of articles that are to be stuffed in the packages. One type of package is particularly suitable for attachment to a header card another package is designed to facilitate the insertion of debit cards. An array of receptacles are formed and placed on a sheet and a pattern of adhesive formed on another sheet. The receptacles are registered with the pattern in such manner that top edges of the receptacles are in contact with and can pull of the adhesive so that the receptacles are conveniently placed on a header card. Several embodiments are shown and described.

2 Claims, 6 Drawing Sheets

ARTICLE HOLDERS FOR USE IN CREATING DISPLAY ARTICLES

PRIOR APPLICATION

This patent application claims the benefit of a prior filed U.S. Provisional Patent Application Ser. No. 60/022,358, filed Jul. 24, 1996, entitled "Article Holders For Making Displays" and filed by Alexander Sloot as the applicant and assigned to the small entity Printmark Industries, Inc.

FIELD OF THE INVENTION

The invention relates to the field of holders for articles, either for retail display or mailings, that can be easily processed without the need of special equipment.

BACKGROUND OF THE INVENTION

Devices for forming plastic packaging have been available for a long time in diverse forms. See for example, U.S. Pat. No. 4,549,658 in which a mini disk holder is formed of a pair of heat sealed thermoplastic sheets with a pocket between the sheets with one of the sheets having a slit to insert amini disk. Other similar patents of interest are U.S. Pat. Nos. 3,894,684; 3,942,640; 4,320,246; 4,353,461, 4,844,246 and 5,031,772. U.S. Pat. No. 3,856,144 teaches a blister package wherein pills can be placed in small receptacles and dispensed by pushing a pill out from one side by rupturing an overlying sheet.

Of particular interest is the U.S. Pat. No. 3,456,867 to Repko in which a plurality of bags are assembled with flexible webs. Other bag structures and method for making these are described in U.S. Pat. Nos. 2,550,000 and 5,044,772. U.S. Pat. Nos. 4,759,642 and 4,932,791 describe self sealing envelopes.

What is needed is a convenient technique to package small runs of articles with packages that easily adapted for such purpose.

SUMMARY OF THE INVENTION

With laminate structures and preformed sheets in accordance with the invention it is convenient to assemble a plurality of self sealing packages on a sheet and adapting these for insertion of articles in an efficient manner. This is achieved in accordance with one technique of the invention by forming an adhesive carrier sheet on which a pattern of adhesive is placed and then another sheet with preformed receptacles is align with the pattern so that the edges of the receptacles are in contact with the pattern. The adhesive on the carrier sheet makes a sufficient bonding contact with the receptacle edges to be transferred thereto and remain affixed for subsequent sealing after an article is placed in the receptacle.

The adhesive carrier can be fully covered by the adhesive or the adhesive can be placed in a pattern that conforms to the shape of the top peripheral edges of the receptacles.

In another embodiment in accordance with the invention individually removable packages are formed on a carrier sheet having adhesive thereon to enable the attachment of the packages onto header cards and the like.

It is, therefore an object of the invention to provide various packaging structure with which small runs of articles can be conveniently packaged in a manual manner.

This and other objects and advantages of the invention can be understood from the following detailed description of various embodiments as shown in the drawings.

DETAILED DESCRIPTION OF THE INVENTION

Figure 2:
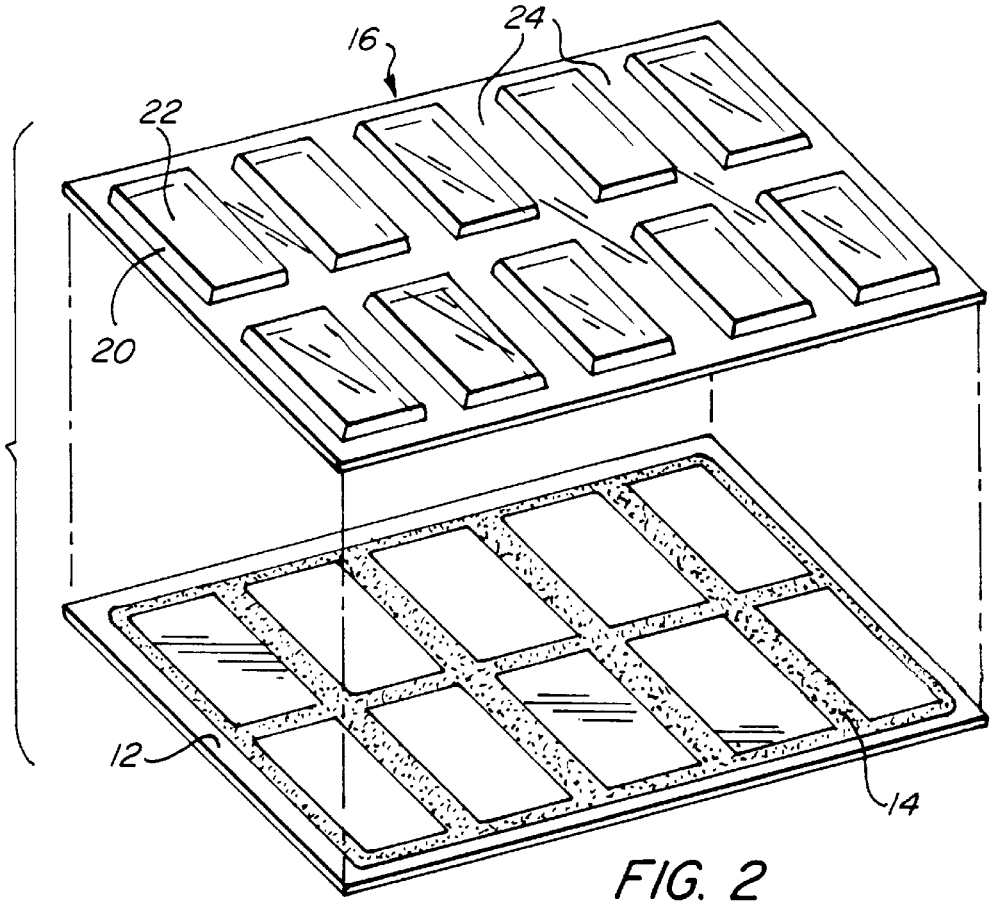
FIG. 2 is an exploded, front isometric view of a laminate used to produce an array of packaging blisters illustrated in FIG. 1.

With reference to FIGS. 1 through 4 a first embodiment of an array 10 of packaging blisters 30 in accordance with the invention is illustrated for use in applying an article 34 to a header card 32 to create a display unit 36 without the need of specialized equipment or skills. A single packaging blister 30 can be removed from array 10 of packaging blisters 30 and used to create displays for an article 34.

FIG. 2 illustrates the method for preparing array 10 of packaging blisters 30. A sheet of release material 12 is first provided. Release material 12 can be of any size and type which meets the needs of the user. Typical types of release material 12 are clay coated, polycoated, or silicon coated paper or silicon coated polyethylene, having approximately a 60 to 90 lbs. weight, and a dimension of approximately 12 in. by 18 in.

Also provided is a semi-rigid, preformed plastic sheet 16 which contains from one to several removable packaging blisters 18. Semi-rigid, preformed plastic sheet 16 can be composed of any material that has sufficient rigidity and strength to retain article 34 and to display it satisfactorily. Preferably a rigid vinyl material is used, such as a transparent, rigid polyvinylchloride (PVC) having a thickness of approximately 0.01 inch.

Packaging blisters 18 are made up of a closed side wall 20 having at one end a transversely extending top wall 22. At the other end of side walls 20, opposite top wall 22, is a flange 24. All flanges 24 in semi-rigid, preformed plastic sheet 16 are co-planar. Although a rectangular packaging recess 18 has been illustrated in the figures, any size and shape of packaging recess 18 is contemplated within the scope of the invention. Typically packaging recess 18 dimensions will be dictated by the desired article 34 to be displayed.

A layer of adhesive 14 is deposited on sheet of release material 12. Semi-rigid, preformed plastic sheet 16 is positioned over adhesive 14, so that flanges 24 are in contact with adhesive 14 and packaging recesses 18 extend away from release material 12, thus forming a laminate 25. Adhesive 14 can be of any type which adheres to release material 12 with less tenacity than it adheres to semi-rigid, preformed plastic sheet 16, so that adhesive 14 will detach from release material 12 and transfer to semi-rigid, preformed plastic sheet 16 in all locations where semi-rigid, preformed plastic sheet 16 comes in contact with adhesive 14. Preferably, pressure sensitive or heat activated adhesive is used, but the choice is typically dictated by the equipment used to press and cut semi-rigid, preformed plastic sheet 16, as later described.

Adhesive 14 may be deposited in any pattern so long as there is adhesive 14 in all areas where flanges 24 of semi-rigid, preformed plastic sheet 16 are adjacent to release material 12. The entire sheet of release material 12 may be coated or a pattern of adhesive 14 may be printed onto release material 12 wherein the pattern shape corresponds to the shape of flanges 24, as illustrated in FIG. 2. Although any layer of adhesive 14 would be sufficient to enable the invention, when adhesive 14 is printed to correspond to the flanges 24, the sheet of release material 12 is more manageable.

Laminate 25 is subjected to a cutting operation which simultaneously ensures adhesion between semi-rigid, preformed plastic sheet 16 and adhesive 14 and severs semi-rigid, preformed plastic sheet 16 at the midpoint of flange 24 which separates two adjacent packaging recesses 18, thereby creating separate packaging blisters 30.

Figure 3:
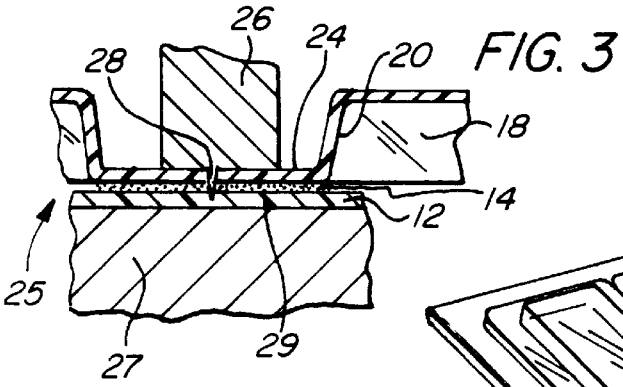
FIG. 3 is a cross sectional view of the consolidated laminate in FIG. 2 as it is being pressed and cut to form an array of packaging blisters in accordance with the invention.
Figure 1:
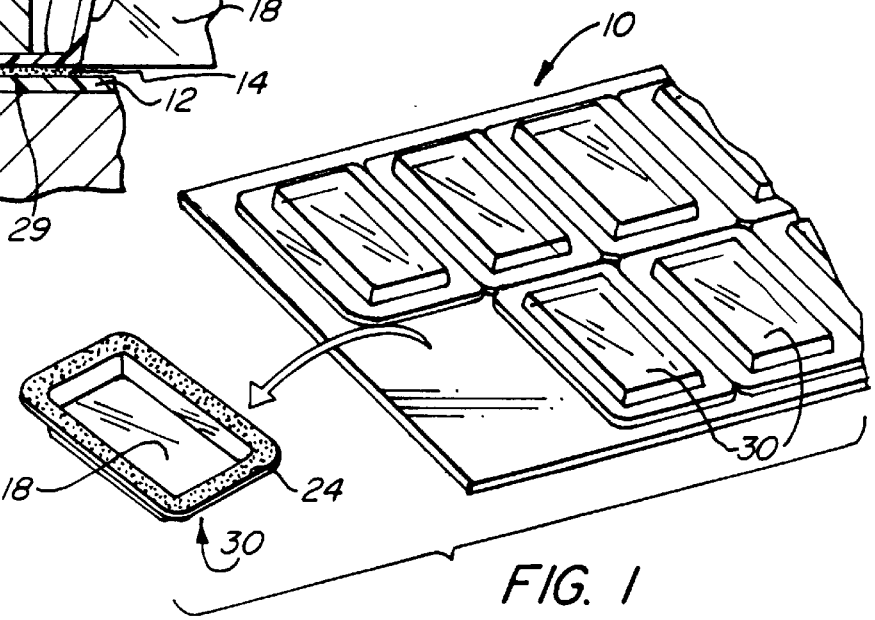
FIG. 1 is a front isometric view of an array of packaging blisters in accordance with a first embodiment of the invention, with a single packaging blister removed to illustrate the adhesive affixed to the flanges.

Several different types of processes can be employed to carry out this adhering/severing process, as generically illustrated in FIG. 3 where a pressing/cutting means 26, having a plateau region 29 and a tip 28 on one side of laminate 25 and a backer 27 on the other side. For example, a thermal die cutting, knife die cutting, sonic sealing, or RF (Radio Frequency) sealing could be employed. Preferably, an RF sealing process is used wherein plateau region 29, which is parallel to flanges 24, presses pressure sensitive adhesive or activates heat activated adhesive, so that adhesive 14 adheres to flanges 24. At the same time tip 28 severs semi-rigid, preformed plastic sheet 16, but does not score release paper 12. A sonic sealing or a thermal die cutting process could similarly be employed wherein heat is emitted to activate heat activated adhesive (or alternatively pressure is used to cause pressure sensitive to adhere to flange 24) and to sever semi-rigid, preformed plastic sheet 16.

Alternatively, a knife die could be used for the adhering/severing process. Plateau region 29 would again work to press laminate 25 to ensure transfer of pressure sensitive adhesive to flanges 24 and tip 28 cuts through at least semi-rigid, preformed plastic sheet 16. The depth of the resulting cut through laminate 25 can be tailored. For example, in order to retain an array 10 of packaging blisters 30, the height of tip 28 and the pressure applied during the cutting operation are selected so that only the semi-rigid, preformed plastic sheet 16 is cut, not the underlying release material 12. Alternatively, it may be desired to cut through either a portion or the entire depth of release material 12 to render the single packaging blisters 30 and corresponding release material 12 detachable or disconnected.

An alternative approach to forming an array 10 of packaging blisters 30 can be employed which utilizes a pre-made pressure sensitive vinyl material. In this method, a pre-made pressure sensitive vinyl laminate is used which has a layer of release material, adjacent to a layer of adhesive, adjacent to a layer of flexible or rigid, pressure sensitive vinyl (not shown). This pre-made pressure sensitive vinyl laminate is then "kiss cut," that is subject to a sonic or RF (Radio Frequency) operation which cuts through the vinyl and adhesive but not the release material, creating a pattern in the vinyl which corresponds to the shape of flanges 24. Semi-rigid, preformed plastic sheet 16 is placed in register with the kiss-cut pre-made pressure sensitive vinyl laminate so that flanges 24 are aligned with the pattern created during the kiss cutting operation. The semi-rigid, preformed plastic sheet 16 and pre-made pressure sensitive vinyl laminate are subject to RF sealing which both causes the pressure sensitive vinyl to adhere to flanges 24 and cuts the adhered flanges 24 and pressure sensitive vinyl material, as described above, to create single packaging blisters 30.

Array 10 of packaging blisters 30 is now complete and can be sold and shipped to anyone desiring to easily package any article on a header card to prepare display units 36.

Figure 4:
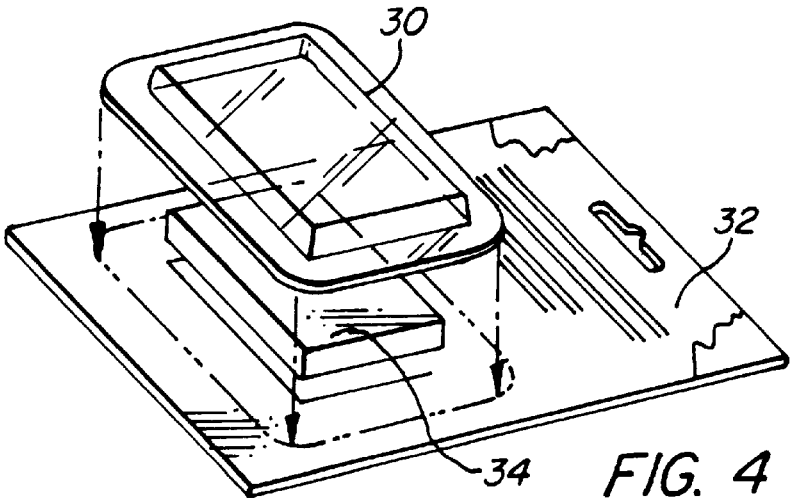
FIG. 4 is a front isometric view of the formation of a final display unit for an article using a single packaging blister as illustrated in FIG. 1.
Figure 8:
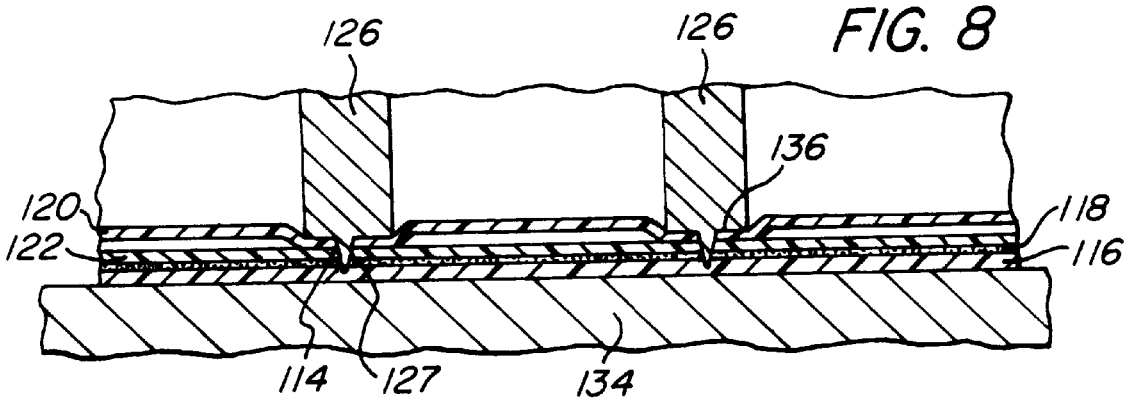
FIG. 8 is a cross sectional view of the consolidated laminate of FIG. 6 as it is pressed and cut to form the array of packaging envelopes of FIG. 5.

FIG. 4 illustrates the method for completing display unit 36. An article 34 to be displayed is set on a header card 32. A single packaging blister 30, with adhesive 14 on the side of flanges 24 adjacent release material 12, is removed from the sheet of release material 12. Packaging blister 30 is placed on header card 32 such that adhesive 14 is in contact with header card 32 and article 34 is predominantly or wholly contained in packaging recess 18.

FIGS. 5–11 illustrate a second embodiment of an array 100 of packaging envelopes 102 for use in applying articles 130 onto a header card 132 to create a display unit 128 without the need of special equipment or machinery. A single packaging envelope 102 can be removed from array 100 of packaging envelopes 102 and used to create a display for an article 130.

Two methods can alternatively be employed in preparing array 100 of packaging envelopes 102. In the first method, at least one strip of flexible plastic envelopes 104 is provided. Strip of flexible plastic envelopes 104 has a first, flexible plastic sheet 120 having a main portion 106 and a flap portion 108 attached to main portion 106, along a first edge 110. Strip of flexible plastic envelope 104 also has a second, flexible plastic sheet 122 which has identical dimensions to main portion 106 of first, flexible plastic sheet 120 placed in register to main portion 106 of first, flexible plastic sheet 120. Each single flexible envelope 102 is sealed on three edges, the edge 112 opposite the first edge 110, and the two edges 114 perpendicular to the first edge 110.

This type of strip of flexible plastic envelopes 104 is well known in the industry and can be formed from any material which is sufficiently strong to protect article 130 to be displayed, yet flexible enough to accommodate the item which packaging envelope 104 will be attached to. It is contemplated that strip of flexible plastic envelopes 104 would be made by sealing an appropriately shaped flexible or rigid, transparent vinyl (polyvinylchloride) to a correspondingly shaped pressure sensitive plastic vinyl along edges 112 and 114, leaving first edge 110 open.

Figure 6:
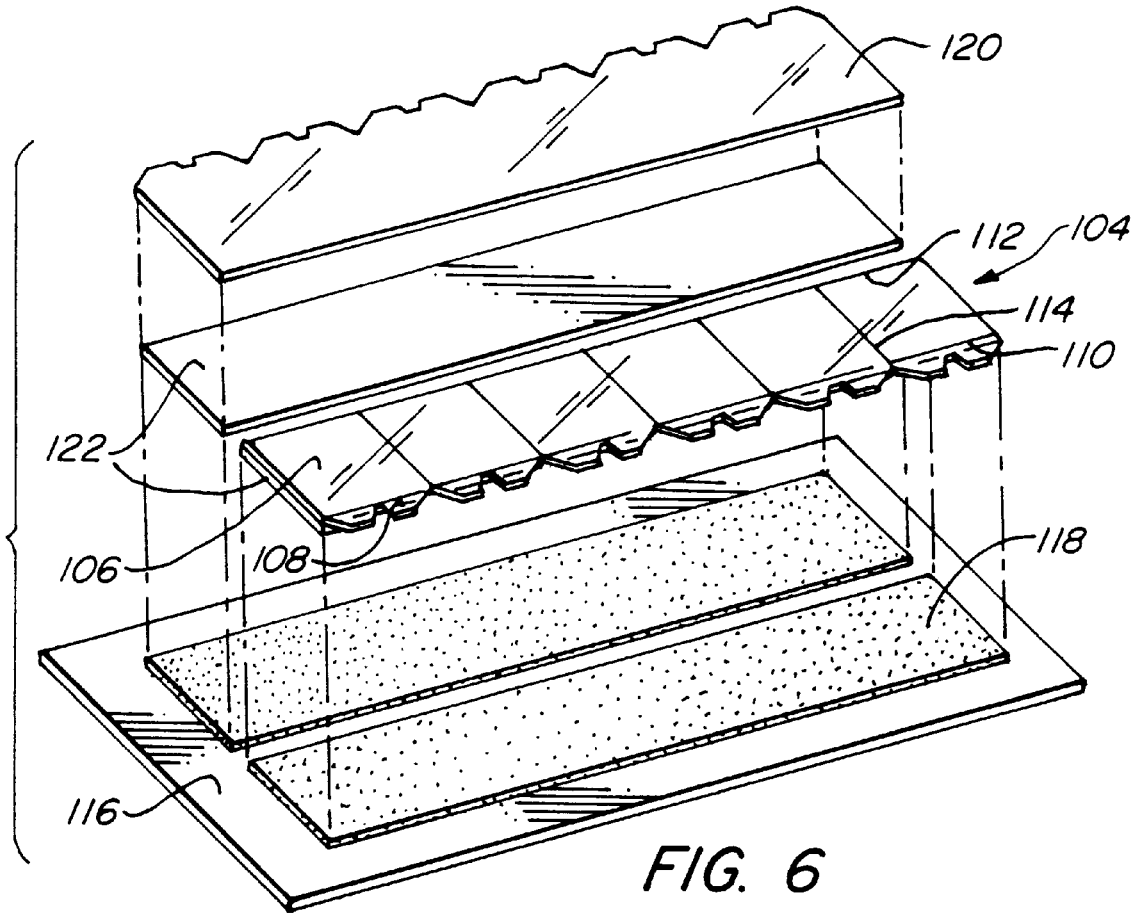
FIG. 6 is an exploded, front isometric view of a laminate of packaging envelopes used to create the array of packaging envelopes depicted in FIG. 5, to illustrate the positioning of the different elements during the production of the laminate.
Figure 5A:
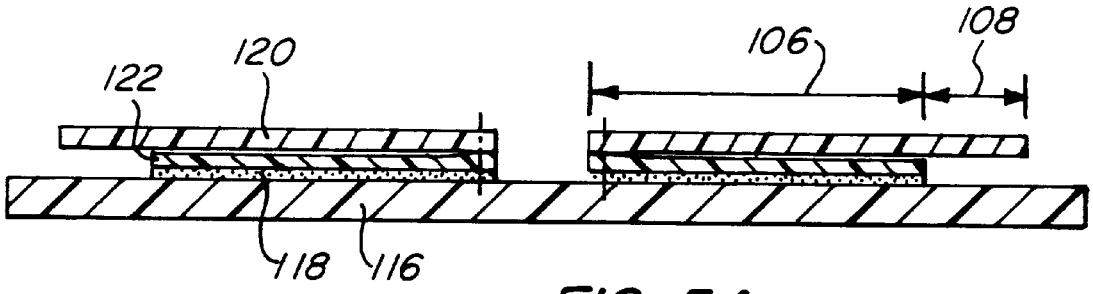
FIG. 5A is a cross sectional view along the 1—1 line of FIG. 5 to illustrate the dimensional relationship of the different elements of a packaging envelope.

Also provided is a sheet of release material 116 similar to that used for the first described embodiment. A layer of adhesive 118 is deposited on release material 116. Adhesive 118 can again either be deposited to cover most of the surface of release material 116, or it can be deposited in strips having identical dimensions to second, flexible plastic sheet 122 as shown in FIG. 6. The type of adhesive must be such that it is capable of being deposited on release material 116 yet will adhere to material used to make second, flexible plastic sheet 122 with more tenacity.

Strip of flexible plastic envelopes 104 is positioned on adhesive 118 so that flap portion 108 does not touch adhesive 118, thus creating a laminate 124. This may be accomplished by either printing adhesive 118 so that it has the exact dimensions of second, flexible plastic sheet 122 and positioning strip of flexible plastic envelopes 104 so that adhesive 118 and second, flexible plastic sheet 122 are exactly in register. This may also be accomplished by covering the entire sheet of release material 116 with adhesive 118 and positioning strip of flexible plastic envelopes 104 so that flap portion 108 hangs off an edge of release material 116.

Figure 5:
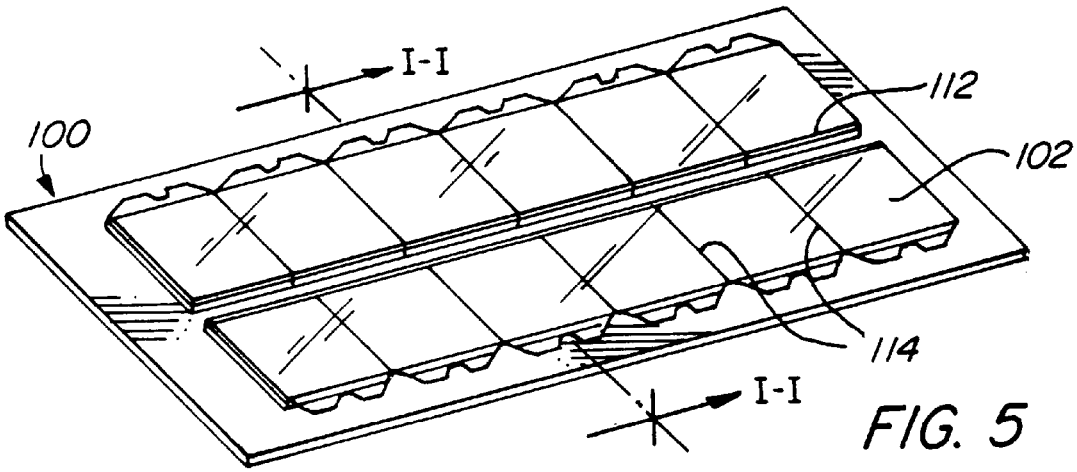
FIG. 5 is a front isometric view of an array of packaging envelopes in accordance with the second embodiment of the invention.

It should also be understood that although the invention has been described as using "strips" of flexible envelopes, as illustrated in FIGS. 5 and 6, the flexible envelopes may also be attached at edge 112 opposite the first edge 110, thus creating a "sheet" of flexible envelopes.

Figure 7:
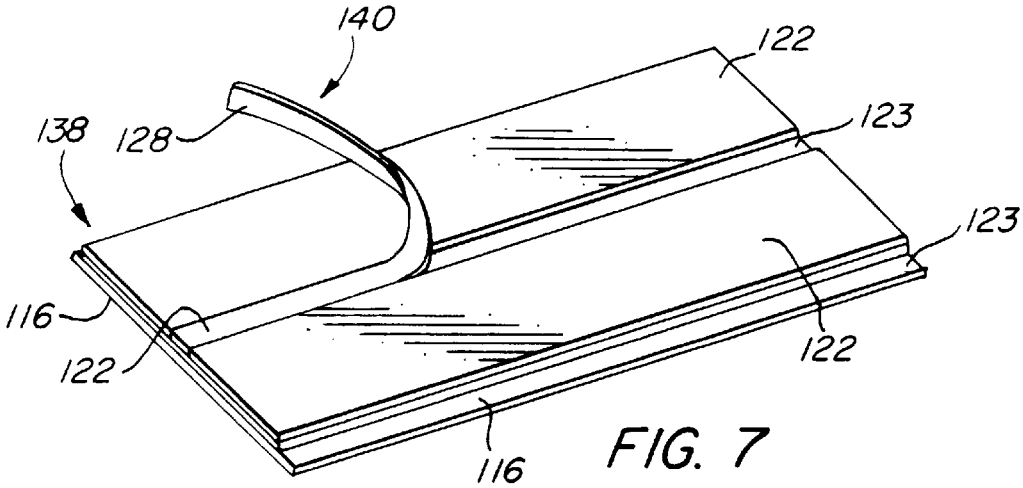
FIG. 7 is a front isometric view of a laminate in an alternative method to create an array of packaging envelopes depicted in FIG. 5.

Laminate 124 is subjected to an adhering/severing step, similar to that disclosed in embodiment one, which both presses strip of packaging envelopes 104 against adhesive 118, and simultaneously cuts strip of packaging envelopes 104 to separate adjoining packaging envelopes 102 at edges 112 and 114. FIG. 7 illustrates the pressing/cutting means 126 which combines a plateau region 136 and a tip 127 on one side of laminate 124 and a backer 134 on the other side. Any adhering/cutting method described in embodiment one can also be applied here. The preferred method is RF sealing.

Array 100 of packaging envelopes 102 can also be formed using an alternative method as illustrate in FIG. 7. FIG. 7 depicts a laminate 138 containing a sheet of release material 116, a second, flexible plastic sheet 122, and a layer of adhesive 118 therebetween. Second, flexible plastic sheet 122 is kiss cut, that is cut using the RF process, thermal, or steel die cutting so as not to score release material 116, so that at least one strip 140 of second, flexible plastic sheet 122 can be removed with adjacent adhesive 118.

First, flexible plastic sheet 120 is positioned in register with laminate 138, so that it is directly adjacent to second, flexible plastic sheet 122, thus creating final laminate 142. Final laminate 142 is subjected to an RF or sonic sealing process which both seals first, flexible plastic sheet 120 to second, flexible plastic sheet 122 along edges 112 and 114 and severs both first, flexible plastic sheet 120 and second, flexible plastic sheet 122 along edges 112 and 114 and cuts out flap portion 108, thereby creating array 100 of packaging envelopes 102.

Array 100 of packaging envelopes 102 is now complete and can be sold and shipped to anyone desiring to easily package any essentially flat article onto a header card to prepare display units 128.

Figure 9:
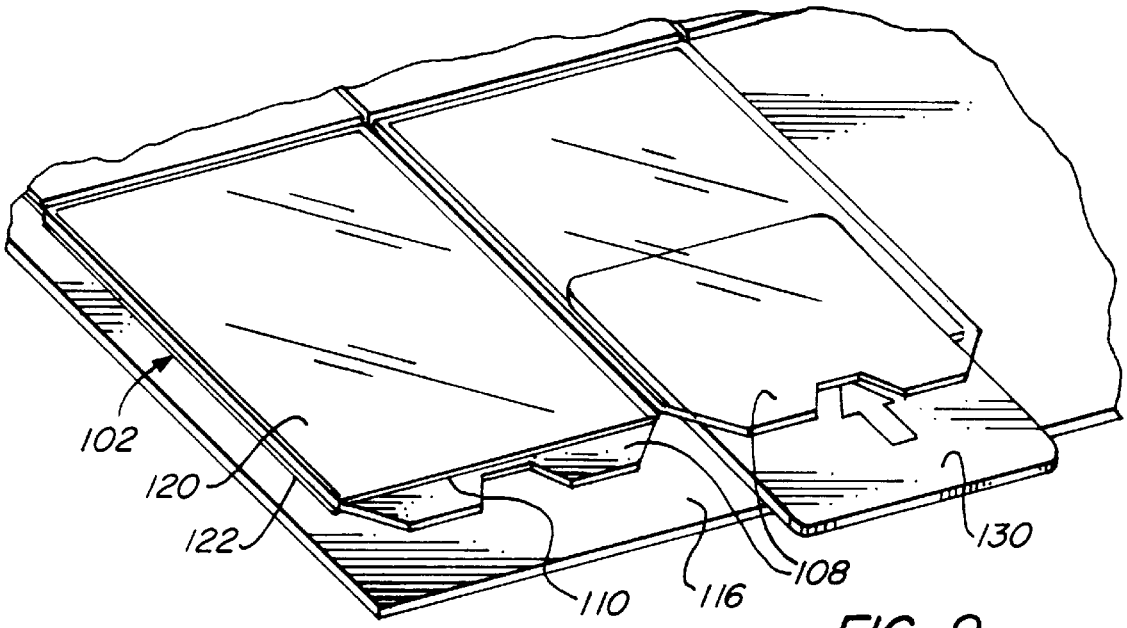
FIG. 9 is a front isometric view of the array of packaging envelopes in FIG. 5 as an article is inserted into a single packaging envelope.
Figure 10:
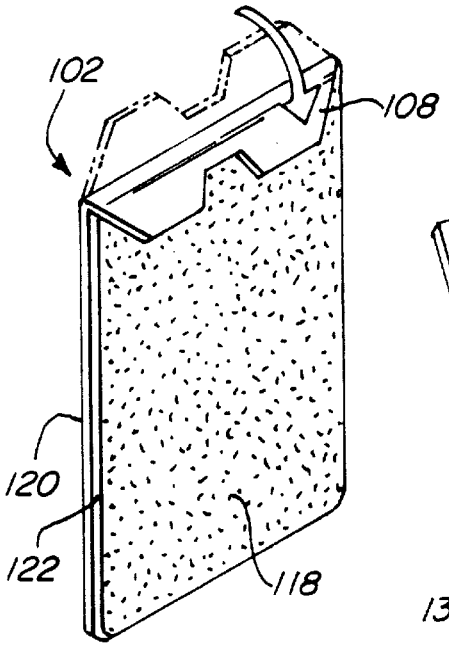
FIG. 10 is a rear isometric view of a single packaging envelope, after an article has been inserted as in FIG. 9 and the single packaging envelope has been removed from the release paper, to illustrate the closing of the single packaging envelope.
Figure 11:
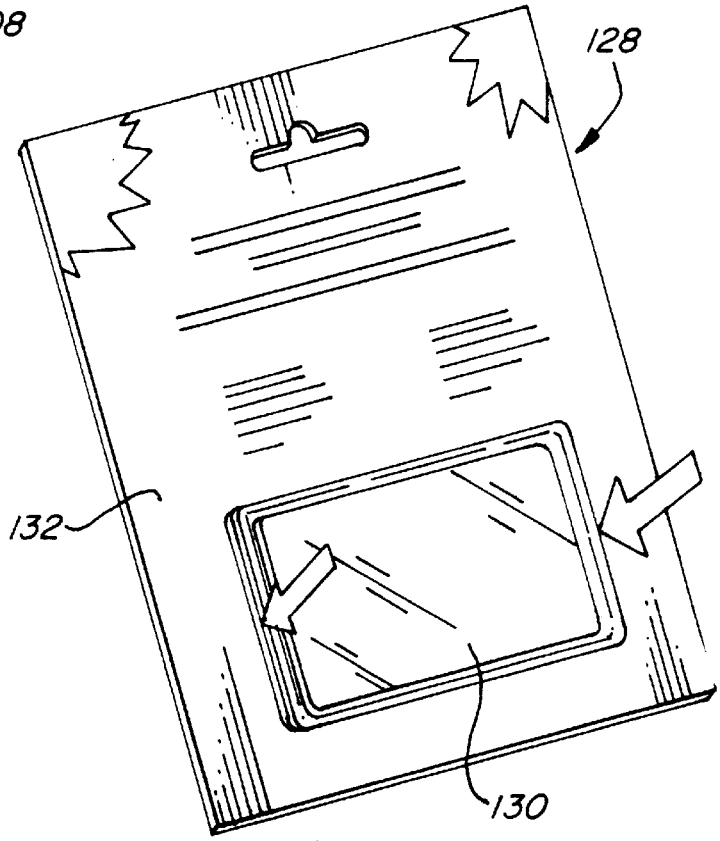
FIG. 11 is a front isometric view of a completed display unit to illustrate the placement of the closed single packaging envelope in FIG. 10 on a header card.

FIGS. 9–11 illustrate the method for completing display unit 128. An article 130 to be displayed is inserted into single packaging envelope 102 by way of the unsealed first edge 110, as illustrated in FIG. 9. Single packaging envelope 102, having adhesive 118 on second, flexible plastic sheet 122, is removed from sheet of release material 116. Flap portion 108 is folded onto adhesive 118 as illustrated in FIG. 10. Single packaging envelope 102 is placed on header card 132 such that adhesive 118 is in contact with header card 132, as illustrated in FIG. 11.

Figure 12:
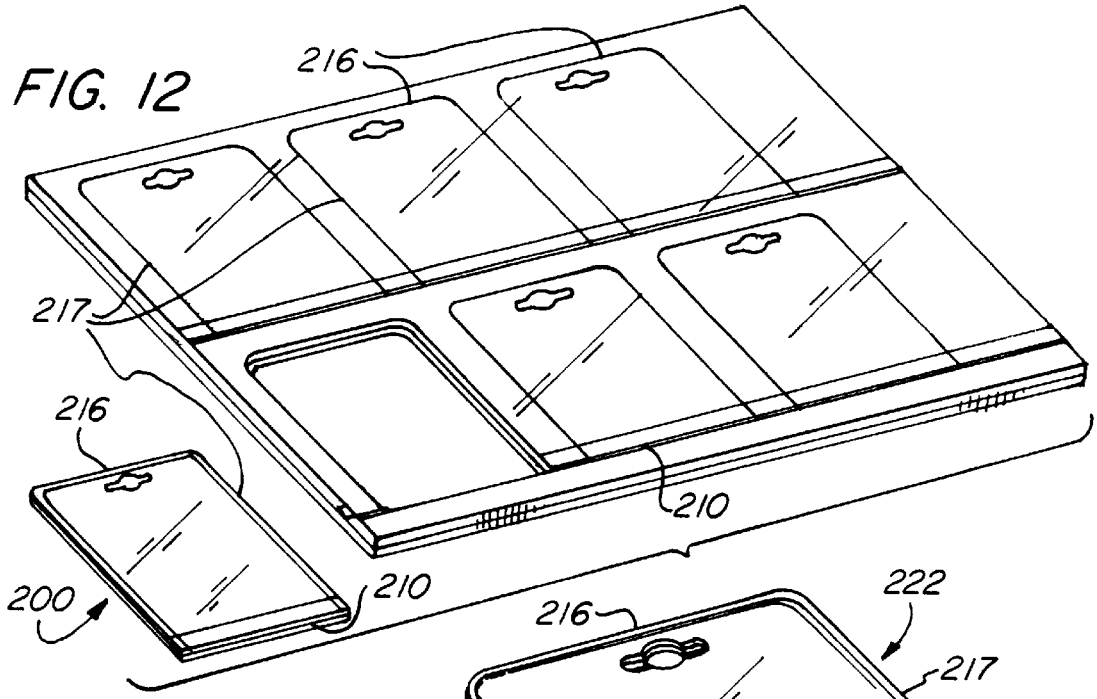
FIG. 12 is a front isometric view of packaging sleeves in accordance with the third embodiment of the invention.

FIG. 12 illustrates a third alternative embodiment in accordance with the invention for creating a packaging sleeve 200 for use in the production of display units 218 without the need for special equipment or machinery. An article 202 to be displayed can be inserted into packaging sleeve 200 at open end 210 and easily sealed to create a fully encapsulated display for article 202.

Referring to FIG. 12, there is provided a first plastic sheet 204. First plastic sheet 204 can be formed from any material which is sufficiently strong to protect article 202, yet flexible enough to accommodate the inserting of article 202. Typically first plastic sheet 204 will be made of a transparent flexible or rigid vinyl or similar material.

A strip of adhesive 206 is deposited onto at least one end of first plastic sheet 204 as illustrated in FIG. 12, or may alternatively be placed down the center of first plastic sheet 204. Strip of release material 208 is then placed on top of strip of adhesive 206 to protect adhesive until it is desired to seal the final product. Alternatively, strip of adhesive 206 and strip of release material 208 may have been previously manufactured together and may alternatively be applied to first plastic sheet 204 as one piece.

Figure 13:
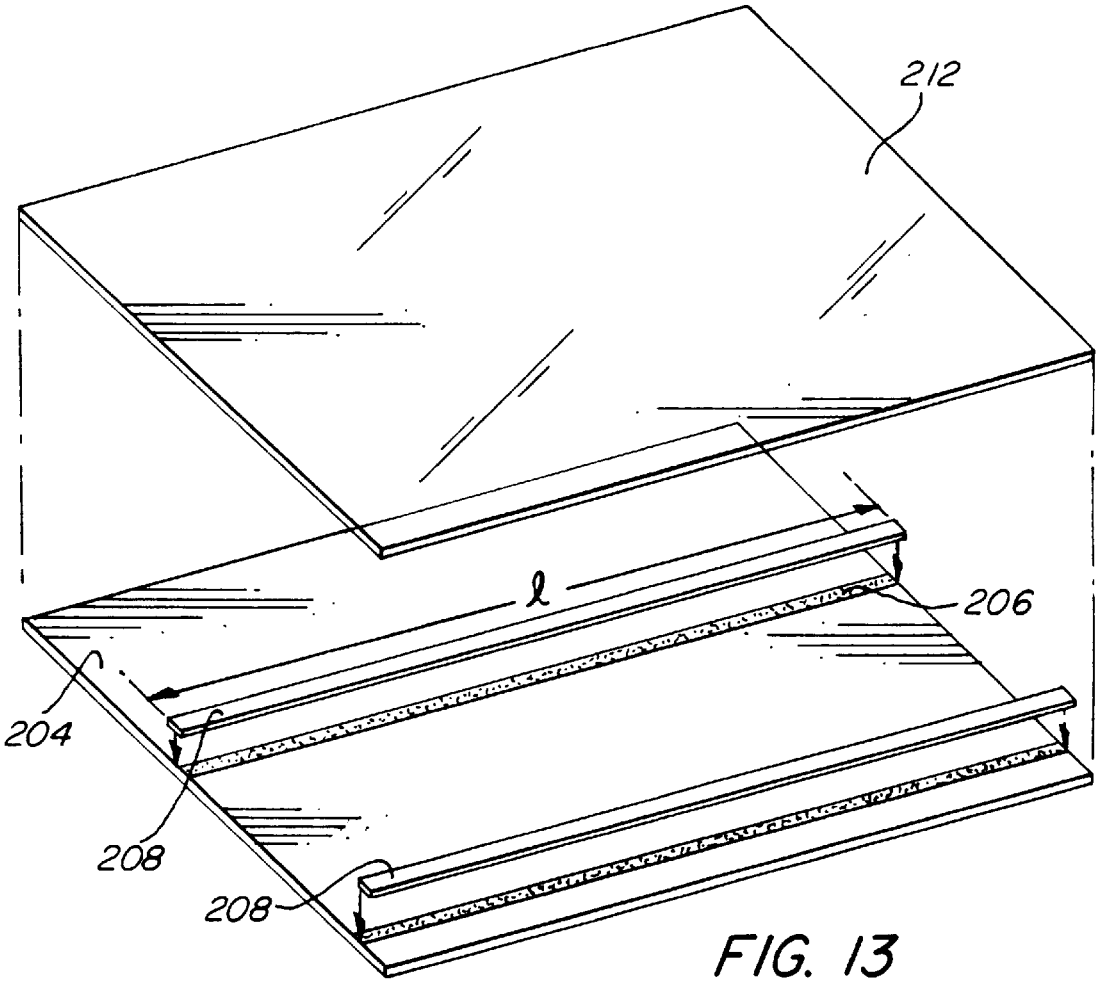
FIG. 13 is an exploded, front isometric view of an intermediate laminate, formed prior to sealing and cutting the packaging sleeves, to illustrate the positioning of the elements with respect to each other.

Both strip of adhesive 206 and strip of release material 208 have a dimension (I) sufficient to entirely traverse an end 210 which will remain open for insertion of the article to be displayed. Strip of release material 208 must at least entirely cover strip of adhesive 206 although it may be longer and/or wider. The number and size of strips of adhesive 206 and strips of release material 208 is entirely dependant on available equipment and desired production rate. FIG. 13 illustrate the use of two strips to create two rows of packaging sleeves 200. This could be modified to a single row or up to as many rows as can be accommodated by available equipment. Additionally, a single strip of adhesive 206 and corresponding strip of release material 208 could be deposited in the middle, so that two rows have in common the same strip of adhesive 206 and release material 208 prior to cutting.

A second plastic sheet 212 is placed in register with first plastic sheet 204 so that strip of adhesive 206 and strip of release material 208 are between the two sheets, thus creating a laminate 214. Second plastic sheet 212 is made of material similar to that used for first plastic sheet 204.

Laminate 214 is then sealed and cut to release packaging sleeves 200. A means for sealing and cutting (not shown) is used to seal and cut the edge 216 opposite strip of adhesive 206 and release material 208, and the edges 217 perpendicular to edge 216, leaving end 210 open. The sealing and cutting operation can be accomplished using any means standard to one of ordinary skill in the art. Preferably thermal, sonic, or RF equipment will accomplish the desired result. An additional cutting step could optionally be employed in which material which extends beyond strip of adhesive 206 and strip of release material 208 is removed using either a die cutting or guillotine cutting means.

Figure 14:
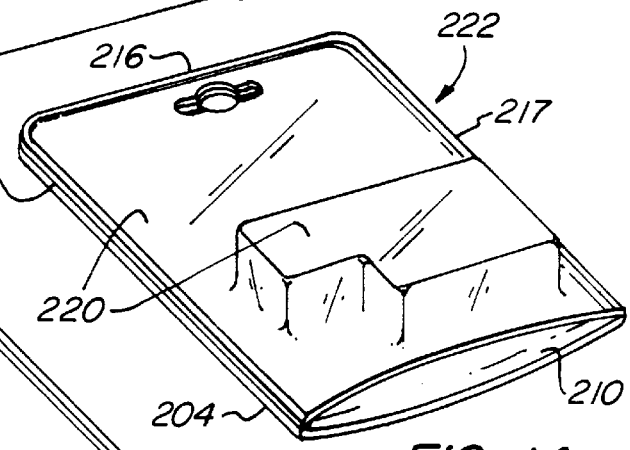
FIG. 14 is a front isometric view of a blister sleeve, an alternative design to the packaging sleeve illustrated in FIG. 12.

As depicted in FIG. 14, the use of tailored shaped first plastic sheet 204 and/or second plastic sheet 212 can be employed to accommodate the packaging and displaying of bulky or uniquely shaped articles 202. A sheet containing preformed blisters 220 is used in place of first plastic sheet 204 and/or second plastic sheet 212 to create a blister sleeve 222.

At this point, packaging sleeves 200 are complete and can be sold and shipped to anyone desiring to prepare display units 218.

Figure 15:
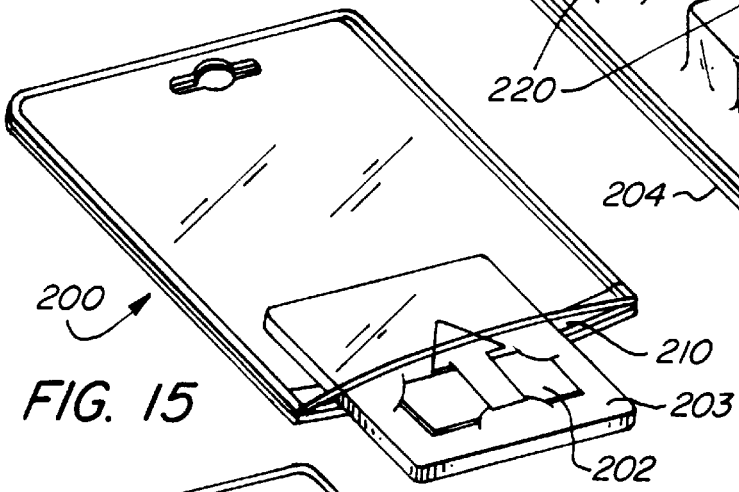
FIG. 15 is a front isometric view of an article being inserted into the packaging sleeve in FIG. 12 to create the final display unit.
Figure 16:
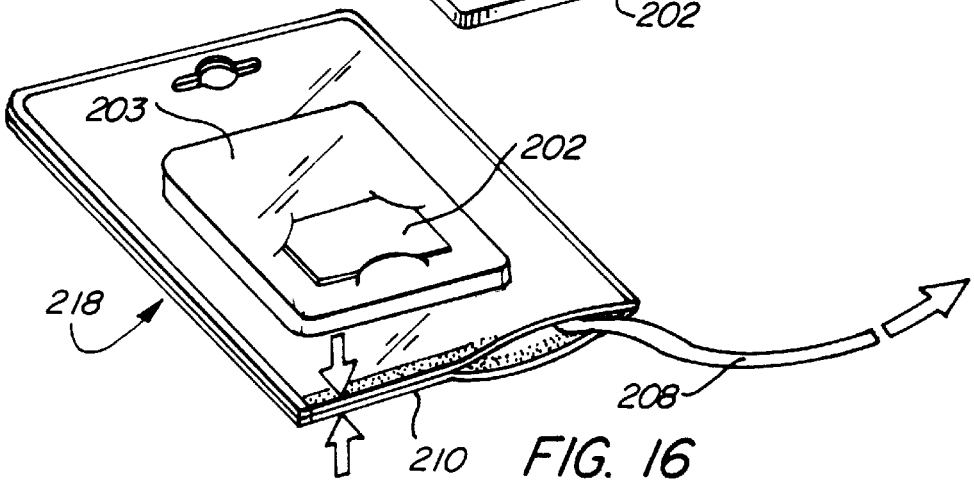
FIG. 16 is a front isometric view of a filled packaging sleeve to illustrate the removal of the strip of release material and the sealing of the packaging sleeve.

FIGS. 15 and 16 illustrate the method for completing display unit 218. Article 202 is typically mounted to a header card 203 and then inserted into packaging sleeve 200 by way of end 210, as illustrated in FIG. 15. When article 202 and header card 203 are completely enveloped in packaging sleeve 200, strip of release material 208 is removed from the surface of strip of adhesive 206, as illustrated in FIG. 16. Open end 210 can now be pressed together, thereby allowing strip of adhesive 206 to seal packaging sleeve 200 and create display unit 218.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A method of making an array of packaging blisters on substrates, comprising:

a) providing a semi-rigid preformed plastic sheet containing packaging blisters; each blister being defined by a side wall and a transversely extending top wall integral therewith, and wherein the side walls of adjacent blisters on the sheet are separated by flanges;

b) depositing adhesive onto a sheet of release material;

c) positioning the semi-rigid preformed plastic sheet on the release material bearing the adhesive so as to bring the flanges of the blisters into contact with the adhesive and form a laminate therewith; and d) pressing and cutting the laminate at locations aligned with the flanges, wherein the pressure applied is sufficient to bring the adhesive into intimate holding contact with the flanges while severing the semi-rigid preformed plastic sheet along the flanges but not the release material; whereby the blisters are individually removable from the release sheet for use as packages on substrates.

2. The method of making an array of packaging blisters on substrates, and further comprising:

lifting a single packaging blister, and the adjacent adhesive, off of the release material;

inserting the article to be displayed into the single packaging blister; and placing the article and the single packaging blister onto a header card.

* * * * *